US008690637B2

(12) United States Patent
Pelotte

(10) Patent No.: US 8,690,637 B2
(45) Date of Patent: Apr. 8, 2014

(54) FLEX-ARM DEVICES AND METHODS

(75) Inventor: Lawrence J. Pelotte, Georgetown, KY (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 1520 days.

(21) Appl. No.: 12/329,917

(22) Filed: Dec. 8, 2008

(65) Prior Publication Data

US 2010/0144252 A1 Jun. 10, 2010

(51) Int. Cl.
*B24B 1/00* (2006.01)

(52) U.S. Cl.
USPC ..... 451/28; 451/360

(58) Field of Classification Search
USPC ..... 451/360, 28
See application file for complete search history.

(56) References Cited

U.S. PATENT DOCUMENTS

| | | | | |
|---|---|---|---|---|
| 1,189,754 | A | 7/1916 | Trenaman | |
| 1,395,626 | A * | 11/1921 | Billingsley | 474/60 |
| 1,674,669 | A * | 6/1928 | Stedman | 408/235 |
| 1,918,952 | A * | 7/1933 | Bachmann et al. | 451/344 |
| 2,327,806 | A * | 8/1943 | Logemann | 451/457 |
| 2,513,213 | A * | 6/1950 | Schick | 451/361 |
| 3,073,085 | A * | 1/1963 | Ticino | 451/389 |
| 3,439,372 | A * | 4/1969 | Collier | 15/53.1 |
| 3,648,316 | A * | 3/1972 | Habian et al. | 15/53.2 |
| 3,849,819 | A * | 11/1974 | Sullivan et al. | 15/88.3 |
| 4,123,877 | A * | 11/1978 | Pere | 451/24 |
| 4,706,575 | A | 11/1987 | Hamlin | |
| 4,953,822 | A | 9/1990 | Sharber et al. | |
| 5,056,268 | A | 10/1991 | Wolff | |
| 5,183,350 | A * | 2/1993 | Kramer | 403/4 |
| 5,213,292 | A | 5/1993 | Evans | |
| 5,890,690 | A | 4/1999 | Klintberg | |
| 6,135,363 | A * | 10/2000 | Titzer | 239/209 |
| 6,550,734 | B1 | 4/2003 | Spadea | |
| 6,711,972 | B1 | 3/2004 | Joyner et al. | |
| 8,500,521 | B2 * | 8/2013 | Boeck et al. | 451/451 |
| 2010/0304648 | A1 * | 12/2010 | Boeck et al. | 451/451 |

* cited by examiner

*Primary Examiner* — Maurina Rachuba
(74) *Attorney, Agent, or Firm* — Dinsmore & Shohl LLP

(57) ABSTRACT

Disclosed is a flex-arm device including a base, at least one support block attached to the base, the support block including a shaft aperture, a shaft engaged with the shaft aperture of the support block, and a flex-arm mount attached to the shaft. When the device is in an unlocked orientation, the shaft is capable of rotation within the shaft aperture such that the flex-arm mount may be angularly displaced about multiple positions, and when the device is in a locked orientation, the shaft is restricted from rotation within the shaft aperture.

20 Claims, 6 Drawing Sheets

FLEX-ARM DEVICES AND METHODS

TECHNICAL FIELD

The invention relates to devices and methods utilized in varying a contact angle between a flex-arm mounted grinding wheel and a surface to be ground.

BACKGROUND

Accurately-ground angled surfaces are often necessary in manufacturing processes. The accuracy of these ground surfaces depends heavily upon the contact angle of an employed precisely-shaped grinding wheel. In many applications, these grinding wheels are mounted on flex-arms only capable of movement in the directional axes of forward and backward, side to side and up and down. In such applications, the flex-arm mounted grinding wheel is therefore only able to accurately grind a surface parallel or perpendicular to the surface on which the flex-arm is mounted. Accordingly, the grinding of angled surfaces in an accurate manner with a flex-arm mounted grinding wheel is difficult due to the limited dynamism provided by the flex-arm.

SUMMARY

One embodiment of a flex-arm device includes a base, at least one support block attached to the base, the support block including a shaft aperture, a shaft engaged with the shaft aperture of the support block, and a flex-arm mount attached to the shaft. When the device is in an unlocked orientation, the shaft is capable of rotation within the shaft aperture such that the flex-arm mount may be angularly displaced about multiple positions, and when the device is in a locked orientation, the shaft is restricted from rotation within the shaft aperture.

Another embodiment of a flex-arm device includes a base, a pair of support blocks attached to the base, each support block comprising a shaft aperture and a set member aperture, a shaft engaged with the shaft apertures, two threaded set members that cooperate with a threaded portion of the set member apertures, and a flex-arm mount attached to the shaft. Rotation of at least one of the set members controls a circumference of at least one of the shaft apertures, wherein when the circumference of at least one of the shaft apertures is the same as a circumference of the shaft, the device is in a locked orientation, and the shaft is restricted from rotation within the shaft aperture, and wherein when the circumferences of the shaft apertures are larger than the circumference of the shaft, the device is in an unlocked orientation, and the shaft is capable of rotation within the shaft aperture such that the flex-arm mount may be angularly displaced about multiple positions.

One embodiment of a method of angling a flex-arm mounted grinding wheel includes providing a flex-arm device comprising a base, at least one support block attached to the base, the support block including a shaft aperture, a shaft engaged with the shaft aperture of the support block, and a flex-arm mount attached to the shaft; engaging a flex-arm with the flex-arm mount, the flex-arm having a grinding wheel mounted thereon; and angling the grinding wheel through rotation of the shaft within the shaft aperture, wherein the flex-arm mount may be angularly displaced about multiple positions through rotation of the shaft, such that the flex-arm engaged with the flex-arm mount may be tilted to multiple positions through the angular displacement of the flex-arm mount, such that the grinding wheel may be tilted through the tilting of the flex-arm.

These and additional features can be more fully understood in view of the following detailed description, in conjunction with the drawings.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION

Figure 1:
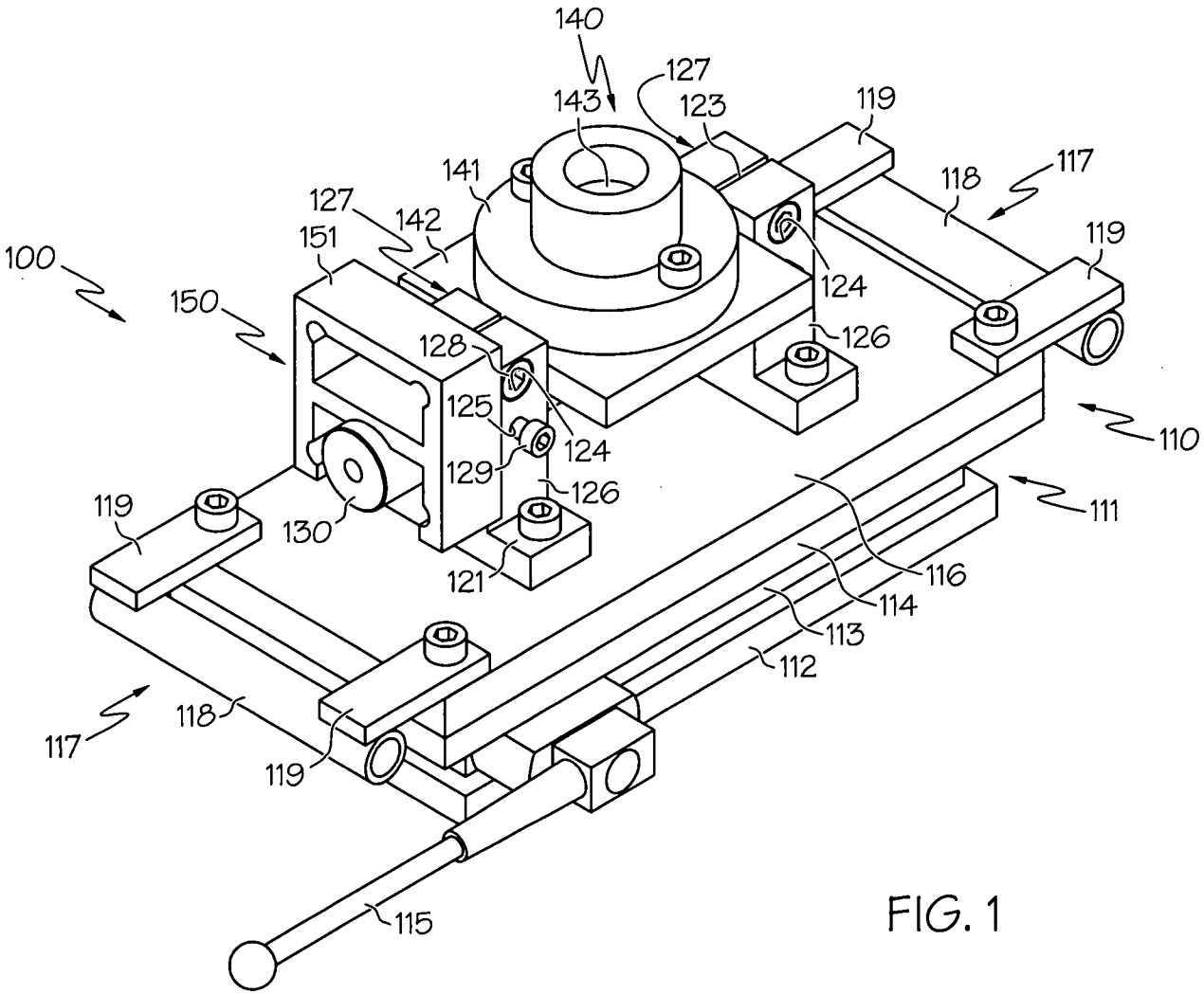
FIG. 1 is a perspective view of an exemplary flex-arm device according to one embodiment of the present invention.

As will be discussed in relation to the figures, embodiments of a flex-arm device 100 may include a base 110, at least one support block 120, a shaft 130 and a flex-arm mount 140. It should be understood, however, that other embodiments of device 100 may include additional structure, such as, for example, a measuring block 150.

Figure 2:
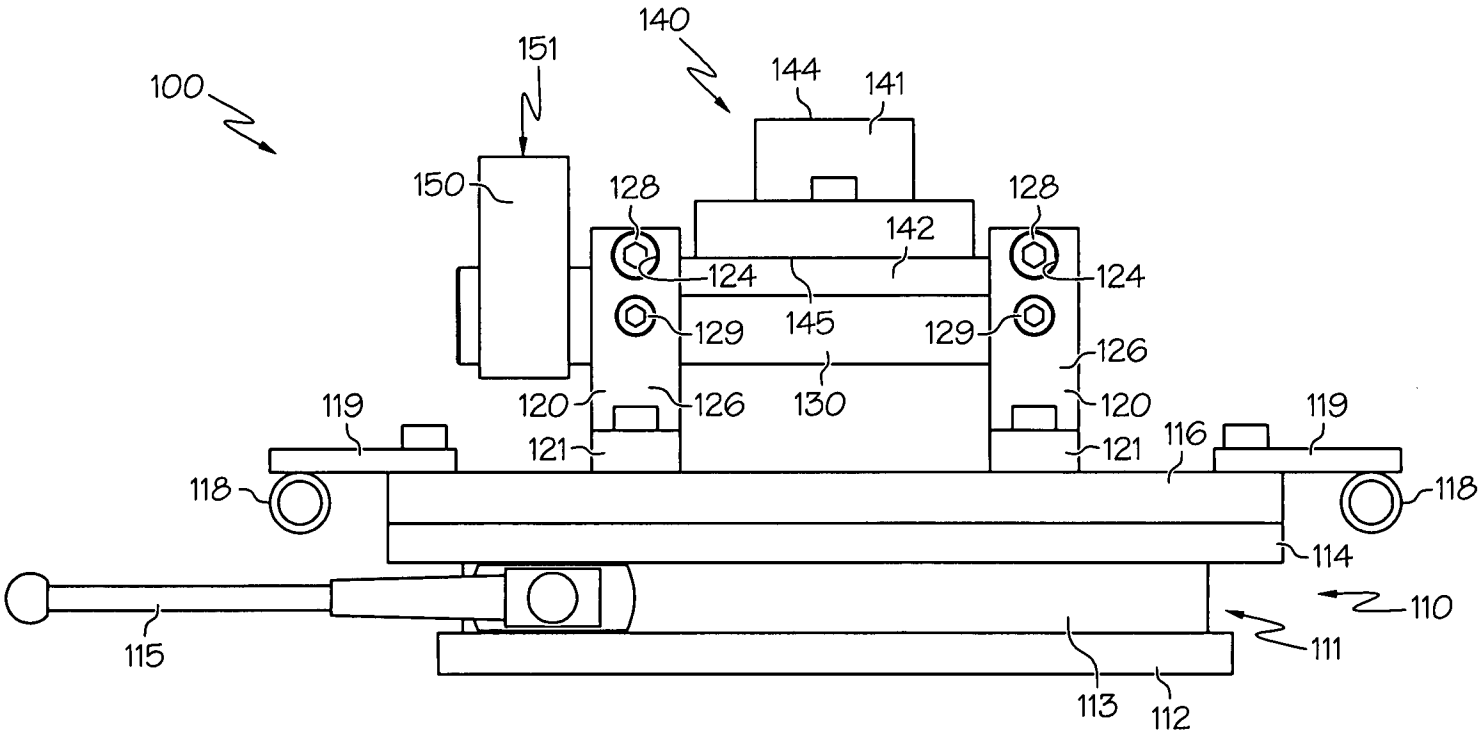
FIG. 2 is a front view of the exemplary device according to the embodiment of FIG. 1.
Figure 3:
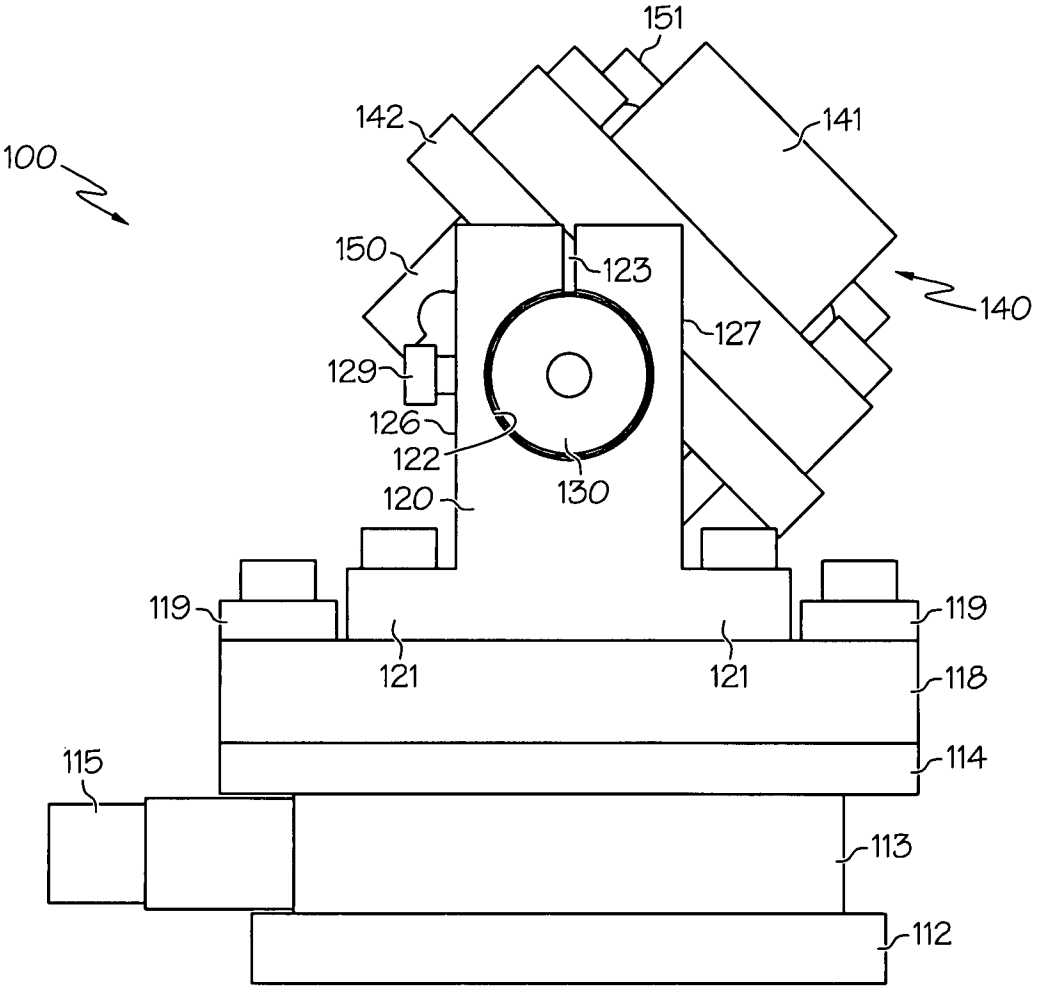
FIG. 3 is a side view of the exemplary device according to the embodiment of FIG. 1.
Figure 4:
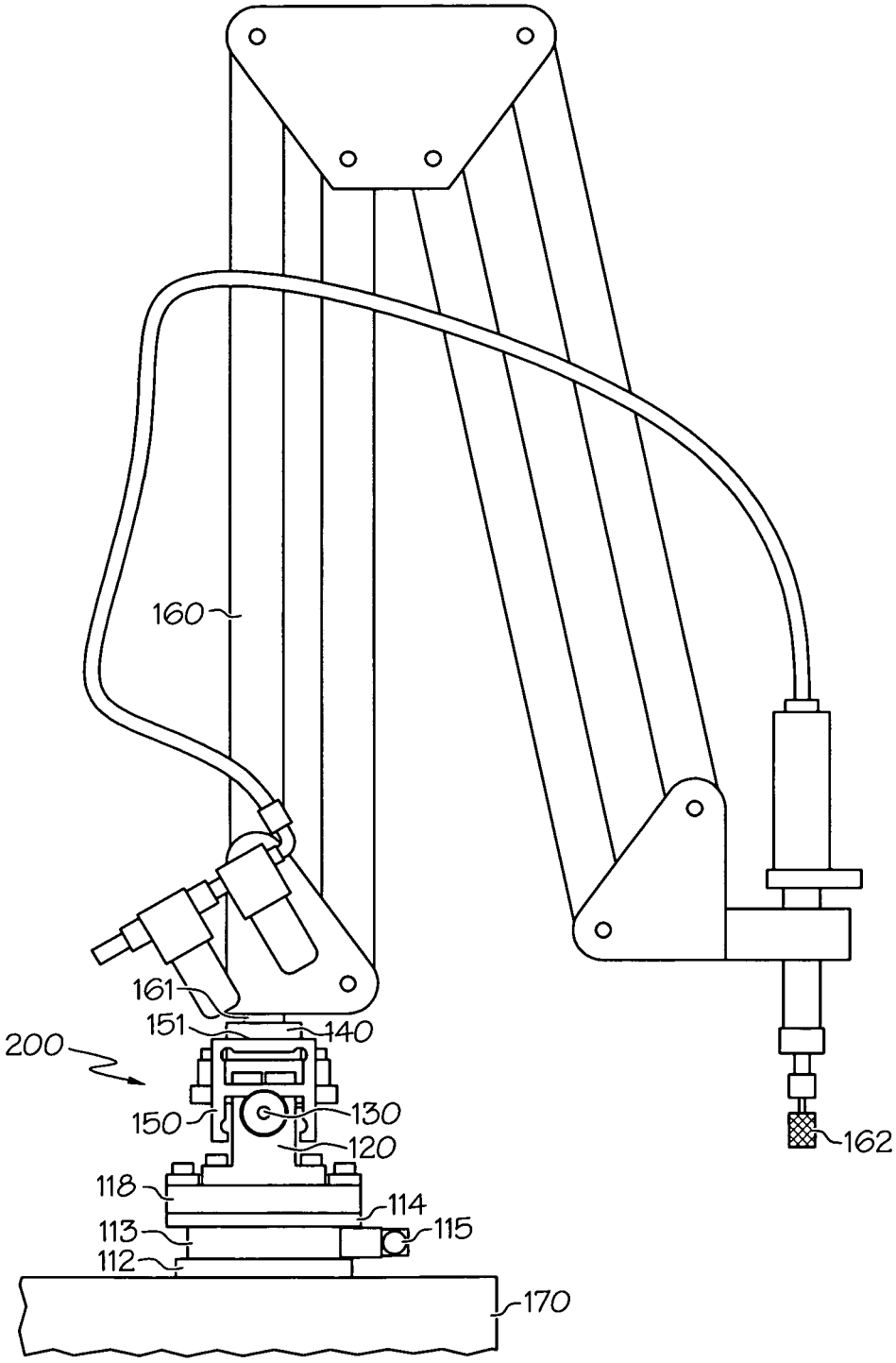
FIG. 4 is a side view of the exemplary device according the embodiment of FIG. 1 with an engaged flex-arm in an upright arrangement.
Figure 5:
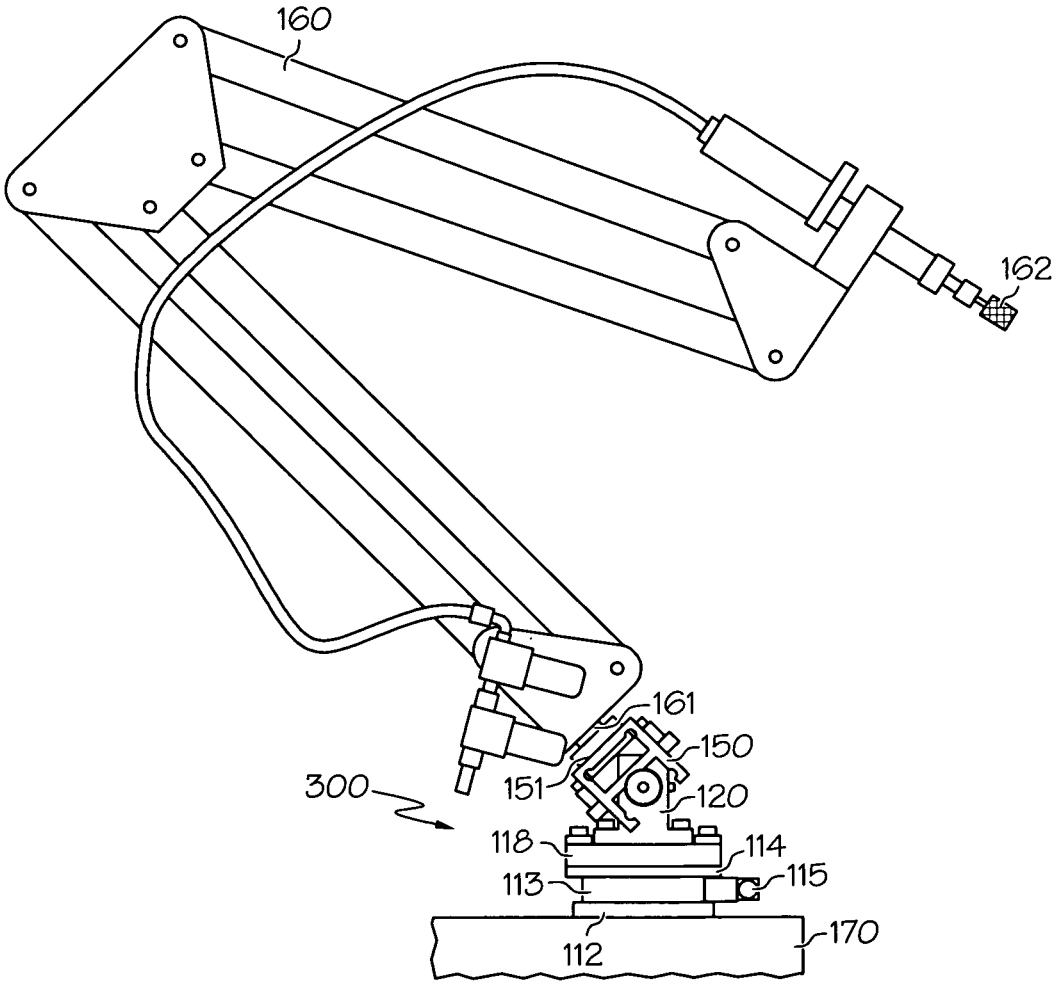
FIG. 5 is a side view of the exemplary device according the embodiment of FIG. 1 with an engaged flex-arm in a backward-tilted arrangement.
Figure 6:
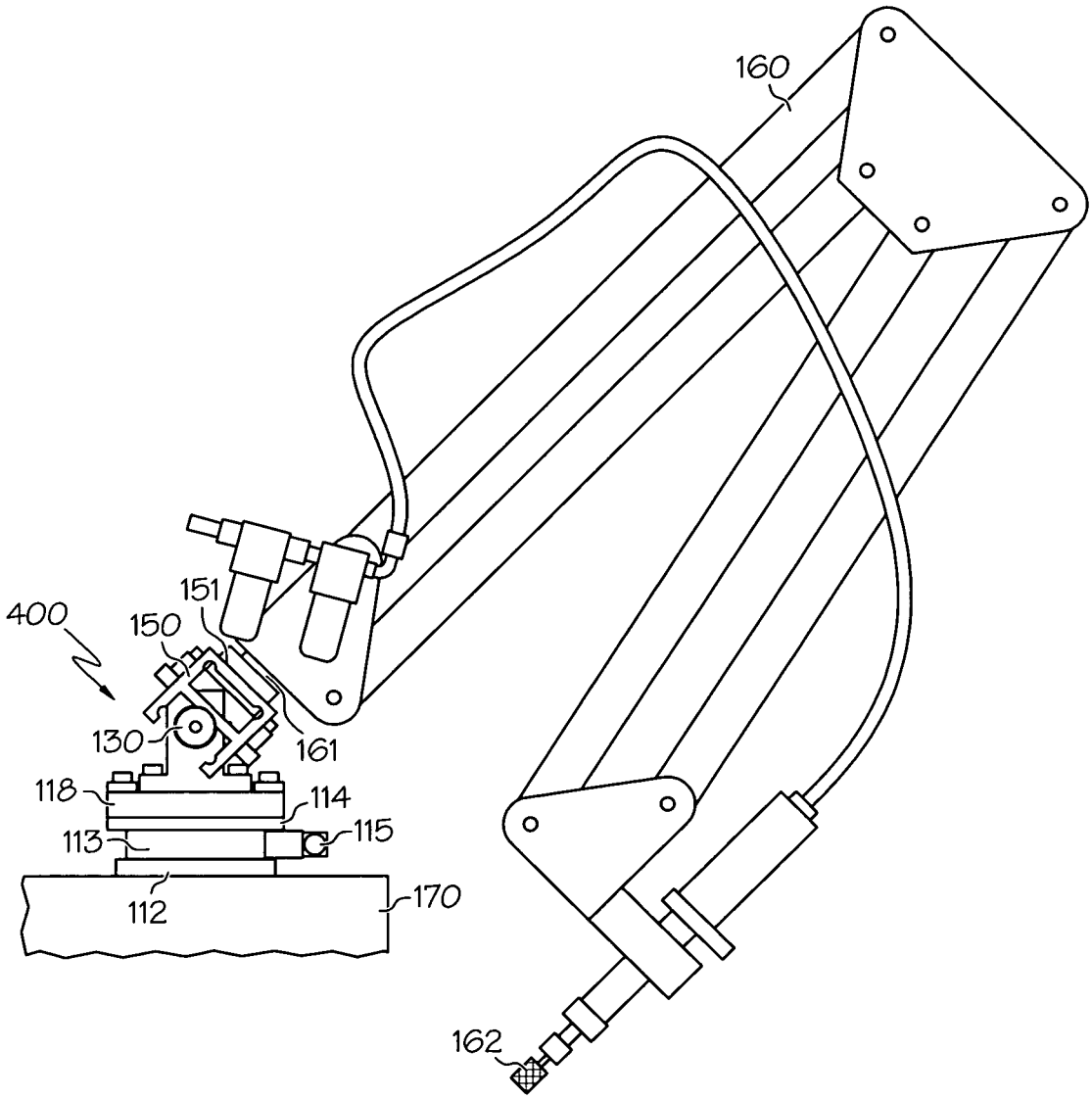
FIG. 6 is a side view of the exemplary device according the embodiment of FIG. 1 with an engaged flex-arm in a forward-tilted arrangement.

Referring to FIGS. 1-6, base 110 may be utilized in the stabilization or attachment of device 100 to any surface. Base 110 may take any shape and/or size and may stabilize or attach device 100 to a surface by any method known in the art. In the illustrated embodiment, base 110 includes a flat, rectangular magnetic chuck 111. Through employment of magnetic chuck 111, base 110 may be utilized to stabilize and/or magnetically attach device 100 to a metal surface plate, metal die or any other magnetically attractive metal surface. Magnetic chuck 111 of the illustrated embodiment includes a bottom plate 112, a middle portion 113, a top plate 114 and a switch 115. As depicted in FIG. 2, bottom plate 112, middle portion 113 and top plate 114 may all be flat in shape, and therefore, the overall magnetic chuck may also be flat in shape. As depicted in FIGS. 4-6, this flat shape enables top plate 114 to be parallel with a flat surface 170 to which magnetic chuck 111 may be attached.

Switch 115 may toggle between a first position (as depicted in FIGS. 1-3) and a second position (rotated 180 degrees to the right). When switch 115 is in a first position, magnetic chuck 111 may be in a demagnetized arrangement, and when switch 115 is in a second position, magnetic chuck 111 may be in a magnetized arrangement. When magnetic chuck 111 is in a demagnetized arrangement, a user may be able to change the position of device 100 on a surface. When magnetic chuck 111 is in a magnetized arrangement on a metal surface, device 100 may be magnetically secured into position. However, embodiments of device 100 need not include a base that includes magnetic chuck 111.

Other embodiments of device 100 may include a base that primarily makes use of the weight of the base and the rest of the device (as well as the weight of an engaged flex-arm) for stabilization on a surface. Again, the base of such embodiments may be of any size and/or shape for a particular application. Embodiments of device 100 may also include a base that employs one or more fasteners to attach and stabilize device 100 on a surface. Additional embodiments of device 100 may include a base for permanent attachment of device 100 on a surface through welding, soldering, adhering and/or bonding.

As shown in FIGS. 1-6, embodiments of device 100 may include base 110 that incorporates a mounting plate 116 and handles 117. In such embodiments, mounting plate 116 may take any shape and/or size and may attach to magnetic chuck 111 through any method known in the art. Non-limiting examples of attachment include utilization of fasteners, welding, soldering, adhering, boding and the like. The illustrated embodiment includes a flat and rectangular-shaped mounting plate to mirror top plate 114 of magnetic chuck 111. The flat shape of mounting plate 116 enables the mounting plate to be parallel with top plate 114 (as shown in FIG. 2), which may be parallel with a flat surface to which magnetic chuck 111 is attached (as shown in FIGS. 4-6). Mounting plate 116 may be utilized as a mount for handles 117, support blocks 120, and other elements of device 100. However, base 110 need not include mounting plate 116, as elements of device 100 may also mount directly on magnetic chuck 111. Handles 117 may be of any shape, size and/or number and may be useful in the transport and positioning of device 100. The illustrated embodiment of device 100 includes two handles 117, with each handle comprising a cylinder 118 welded to two extensions 119 that are mounted to mounting plate 116 through the utilization of fasteners. However, welding and/or fasteners need not be employed, as any method of attachment know in the art may be utilized. Additionally, base 110 need not include handles 117.

Still referring to FIGS. 1-6, at least one support block 120 may be utilized in supporting shaft 130 of device 100. Any number of support blocks 120 may be included in embodiments of device 100, and support block(s) 120 may take any shape and/or size. Support block 120 may attach to mounting plate 116 or magnetic chuck 111 through any method known in the art. Non-limiting examples include utilization of fasteners, welding, soldering, adhering, boding and the like. The illustrated embodiment of device 100 includes two support blocks 120 that incorporate feet 121 that attach to mounting plate 116 through the utilization of fasteners. However, feet 121 need not be included on support block 120 and any method of attaching the support block to either mounting plate 116 or magnetic chuck 111 may be utilized. Additionally, further embodiments of device 100 may include support block(s) 120 and mounting plate 116 formed together in a one-piece construction.

As shown in FIG. 3, support block 120 may include an opening that comprises a shaft aperture 122 and a channel 123. Shaft aperture 122 is round-shaped and sized slightly larger than shaft 130. Therefore, shaft 130 may fit within shaft aperture 122 and still have freedom to rotate within shaft aperture 122. Support block 120 may also include one or more additional apertures for cooperation with a set member and/or a support member. As shown in FIGS. 1 and 2, the illustrated embodiment of device 100 includes support blocks 120 with set member apertures 124 and support member apertures 125. Set member aperture 124 may travel from an opening on the front 126 of support block 120, completely through the support block (therefore crossing channel 123), to the rear 127 of the support block. Set member aperture 124 may or may not include a second opening on rear 127 of support block 120. At least a portion of the section of set member aperture 124 from rear 127 of support block 120 to channel 123 may be threaded for further cooperation with a set member. Additionally, set member aperture 124 may include a countersink portion at front 126 of support block 120 for cooperation with a head of a set member. Support member aperture 125 may travel from an opening on the front 126 of support block 120 to an opening on the circumference of shaft aperture 122. At least a portion of support member aperture 125 may be threaded for further cooperation with a support member.

Embodiments of device 100 may include a set member 128 that comprises a threaded bolt to cooperate with the threaded portion of set member aperture 124, and may be rotated through utilization of an Allen Wrench (a.k.a., hex key wrench). As shown in the illustrated embodiment, set member 128 may fit within set member aperture 124, wherein the head of the set member may at least partially fit within the countersink portion of the set member aperture. Rotation of set member 128 in one direction will advance the set member along the threaded portion of set member aperture 124. When the head of set member 128 is unable to advance further into the countersink portion of set member aperture 124, continued rotation of set member 128 may cause rear 127 of support block 120 and front 126 of support block 120 to move closer together. Accordingly, the width of channel 123 and the circumference of shaft aperture 122 may decrease. When shaft 130 is engaged within shaft aperture 122, the circumference reduction of shaft aperture 122 may restrict and/or stop the ability of the shaft to rotate within the shaft aperture, thus locking the shaft in position. When shaft 130 is restricted from rotation within shaft aperture 122, device 100 is in a locked orientation. Rotation of set member 128 in the opposite direction may retract set member 128 through set member aperture 124. Accordingly, when shaft 130 is in a locked orientation, rotation of set member 128 in the opposite direction may release the device from the locked orientation and allow the shaft to rotate. When shaft 130 is capable of rotation within shaft aperture 122, device 100 is in an unlocked orientation. However, embodiments of device 100 need not include set member 128, as any method or structure now or hereafter known in the art can be utilized to restrict and/or stop the rotation of shaft 130 with shaft aperture 122.

Embodiments of device 100 may include a support member 129. The illustrated embodiment includes support member 129 that comprises a nylon-tipped threaded bolt to cooperate with threaded portion of support member aperture 125. As shown in the illustrated embodiment, at least a portion of support member 129 may fit within support member aperture 125, and rotation of the support member in one direction will advance the support member along the threaded portion of support member aperture 125. When shaft 130 is engaged within shaft aperture 122, support member 129 may advance along support member aperture 125 until the nylon tip of the support member contacts shaft 130. The contact between the nylon tip of support member 129 and shaft 130 may maintain the shaft from disengaging with shaft aperture 122, but such contract is not meant to substantially restrict rotation of the shaft within the shaft aperture. Rotation of support member 129 in the opposite direction may retract support member 129 through support member aperture 125. Accordingly, when shaft 130 is not contacted by support member 129, and the shaft is also not in a locked orientation through utilization of set member 128, the shaft may be able to be removed from shaft aperture 122. However, embodiments of device 100 need not include support member 129.

Referring to FIGS. 1-6, shaft 130 may be utilized in the rotation of flex-arm mount 140. As shown in the illustrated embodiment, and as described above, shaft 130 may be precisely round in shape to engage with shaft aperture 122 of support block 120. Shaft 130 may further include flat sections notched into the shaft to assist in precise attachment of a measuring block and a receiving member plate to the shaft. Shaft 130 may be hollow or solid and of any circumference and/or length for a particular embodiment of device 100. As depicted in FIG. 2, shaft may be in a substantially flush engagement with an opening of a shaft aperture of a first support block and extend outward from an opening of a shaft aperture of a second support block. The extension of shaft 130 may extend outward from a shaft aperture for the attachment of a measuring block or other element of device 100. However, in other embodiments, shaft 130 may be in a flush engagement with the openings of the shaft apertures of more than one support block, or the shaft may extend outward from the openings of the shaft apertures of more than one support block. Shaft 130 may further include apertures (not shown) for the utilization of fasteners to attach flex-arm mount 140 and measuring block 150 to the shaft.

Referring to FIGS. 1-6, flex-arm mount 140 may be utilized in the engagement of flex-arm 160 to device 100. Flex-arm mount 140 may take any shape and/or size and may stabilize or attach flex-arm 160 to device 100 by any method known in the art. In the illustrated embodiment, flex-arm mount 140 includes a two-diameter flex-arm receiving member 141 and a receiving member plate 142. The illustrated embodiment includes receiving member plate 142 that is flat and square-shaped. However, receiving member plate may be of any shape and/or size. Receiving member 141 may attach to receiving member plate 142 through any method known in the art. Non-limiting examples include utilization of fasteners, welding, soldering, adhering, boding and the like. The illustrated embodiment of device 100 includes receiving member 141 that attaches to receiving member plate 142 through the utilization of fasteners. Receiving member plate 142 may attach to shaft 130 through any method known in the art. Non-limiting examples include utilization of fasteners, welding, soldering, adhering, boding and the like. The illustrated embodiment of device 100 includes receiving member plate 142 that attaches to shaft 130 through the utilization of fasteners (not shown).

As depicted in FIG. 1, receiving member 141 may be formed of a one-piece construction with two diameters. The lower/larger diameter is utilized in the attachment of receiving member 141 to receiving member plate 142. The upper/smaller diameter includes a recess 143 utilized to engage at least a portion of extension member 161 of flex-arm 160. As shown in FIGS. 1 and 2, the top surface 144 of receiving member 141 and the bottom surface (not shown) of recess 143 may be flat and parallel to the bottom surface 145 of the receiving member. Accordingly, top surface 144 of receiving member 141 and bottom surface of recess 143 may be parallel to the attached flat receiving member plate 142.

The engagement of flex-arm extension member 161 and receiving member 141 of device 100 may be a "slip-fit engagement." A "slip-fit engagement" is herein defined as at least a portion of an extension member snugly fitting within a recess without the employment of fasteners. A slip fit engagement utilizing a round-shaped extension member and round-shaped recess, as in the illustrated embodiment, may therefore allow for rotation of the extension member within the recess. As depicted in FIGS. 4-6, flex-arm extension member 161 may be supported within recess 143, while also being free to rotate within the recess. Accordingly, flex-arm 160 may be supported on device 100, but still free to rotate from side to side. However, embodiments of device 100 need not include flex-arm mount 140 that employs a slip fit engagement with flex-arm 160. Any method of engagement may be employed, including methods that utilize fasteners.

Referring to FIGS. 1-6, measuring block 150 may be utilized in measuring the angle of attached flex-arm 160 (and therefore the angle of a flex-arm mounted grinding wheel 162) in relation to the surface on which device 100 is attached. Measuring block 150 may take any shape and/or size and may be utilized to measure angles by any method known in the art. Measuring block 150 may be solid, or, as in the illustrated embodiment, may include cut-away portions to reduce the weight of device 100. Measuring block 150 may include a flat top surface 151 for utilization in the measuring of the angle of flex-arm mounted grinding wheel 162 in relation to the surface on which device 100 is attached. Measuring block 150 may attach to shaft 130 through any method known in the art. Non-limiting examples include utilization of fasteners, welding, soldering, adhering, boding and the like. The illustrated embodiment of device 100 includes measuring block 150 that attaches to shaft 130 through the utilization of fasteners (not shown). As illustrated in FIGS. 2 and 3, measuring block 150 may be attached to shaft 130 in an orientation where top surface 151 is parallel to receiving member plate 142 of flex-arm mount 140. Top surface 151 is therefore also parallel with top surface 144 of receiving member 140 and the bottom surface of recess 143. Accordingly, when flex-arm 160 is engaged with flex-arm mount 140, top surface 151 may also be parallel with the bottom surface of a precisely shaped grinding wheel 162 that is mounted on the flex-arm, as shown in FIGS. 4-6. The parallel nature of these surfaces allows a measurement of the angle of inclination of top surface 151 of measuring block 150 to provide an accurate measurement of the angle of inclination of flex-arm mounted grinding wheel 162. Any device, gauge or method of measuring an angle may be employed with measuring block 150 for the measurement of such angles.

The structure of device 100, including the structure of the individual components (for example, base 110, support block 120, shaft 130, flex-arm mount 140 and measuring block 150), may be composed of any suitable material, or combination of materials, now or hereafter known in the art. Non-limiting examples include steel, iron, aluminum, titanium and any other various metal or alloy. The illustrated embodiments are constructed of steel. However, it is not necessary for all individual components of the embodiments of device 100 to be composed of the same material. Certain embodiments of device 100 may include components made from different materials, such as embodiments made of both steel and aluminum.

A flex-arm is generally capable of movement along multiple directional axes. Herein, the term "flex-arm" means any mechanical arm or boom that is capable of dynamism along at least two directional axes. As depicted in FIGS. 4-6, and for purposes of non-limiting illustration only, flex-arm 160 is capable of moving in the directional axes of forward and backward, side to side and up and down. Accordingly, grinding wheel 162 mounted on flex-arm 160 is also capable of dynamism in the directional axes of forward and backward, side to side and up and down. However, in certain applications, grinding wheel 162 may be required to contact a surface to be ground at a precise angle. Accordingly, use of the illustrated embodiment of device 100 allows a user to tilt the entire flex-arm 160, and thus grinding wheel 162 as well, forward or backward to the precise angle required by a particular application. Moreover, while flex arm 160 and grinding wheel 162 are angularly displaced (i.e., tilted) in any one of multiple positions, the grinding wheel is still able to move along at least two directional axes through utilization of the dynamism of the flex-arm. Accordingly, through utilization of device 100, flex-arm mounted grinding wheel 162 is capable of at least two types of displacement: a first type of displacement that allows the grinding wheel to move along at least two directional axes through utilization of a dynamism provided by flex-arm 160, and a second type of displacement that allows the grinding wheel to tilt through the tilting of the flex-arm through the angular displacement of flex-arm mount 140 of the device.

Referring to FIGS. 1-6, when utilizing the illustrated embodiment of device 100, a user may position the device on a surface 170. In applications where the surface comprises a magnetically-attractive metal, the user may toggle switch 115 to place magnetic chuck 111 in a magnetized arrangement, and therefore magnetically secure device 100 to surface 170. Employing a slip-fit arrangement, a user may then place an extension member 161 of a flex-arm 160 into recess 143 of flex-arm mount 140. Referring specifically to FIGS. 1 and 2, if device 100 (now engaged with a flex-arm) is in a locked orientation, a user may rotate set member(s) 128 to retract the set member(s) from set member apertures 124. The retraction of set member(s) 128 will convert device 100 to an unlocked orientation. While in the unlocked orientation, shaft 130 may rotate within shaft aperture 122, which will allow the attached flex-arm mount 140 and measuring block 150 of device 100 to be angularly displaced into a multitude of positions. This angular displacement of flex-arm mount 140 will allow the entire engaged flex-arm 160 (and therefore flex-arm mounted grinding wheel 162) to tilt forward or backward into a multitude of positions. In some embodiments of device 100, flex-arm mount 140 and measuring block 150 are capable of a range of angular displacement of 185 degrees. Accordingly, engaged flex-arm 160 may be capable of tilting forward slightly more than 90 degrees from an upright arrangement (depicted in FIG. 4), as well as capable of tilting backward slightly more than 90 degrees from an upright arrangement. When flex-arm mount 140 is angularly displaced into a desired position, and therefore, when flex-arm mounted grinding wheel 162 is tilted to a desired position, a user may rotate set member(s) 128 to advance them in set member aperture(s) 124. As described above, this advancement of set member(s) 128 will decrease the width of channel(s) 123 and the circumference of shaft aperture(s) 122, restricting shaft 130 from rotation and placing device 100 into a locked orientation.

Flex-arm mount 140 (and therefore flex-arm 160 and mounted grinding wheel 162) can be set and reset into a multitude of positions. FIG. 4 shows device 200 with an engaged flex-arm 160 in an upright arrangement (as does FIGS. 1 and 2, without an engaged flex-arm), wherein the sides of grinding wheel 162 are perpendicular to mounting surface 170 and the bottom of grinding wheel 162 is parallel to mounting surface 170. The sides of grinding wheel 162 are also perpendicular to receiving member plate 142 and top surface 151 of measuring block 150, and the bottom of grinding wheel 162 is parallel to receiving member plate 142 and top surface 151 of measuring block 150. In this arrangement, grinding wheel 162 mounted to flex-arm 160 may still be able to move in the directions of forward and backward, side to side and up and down, but the sides of grinding wheel 162 will remain perpendicular to mounting surface 170, receiving member plate 142 and top surface 151 of measuring block 150, and the bottom of grinding wheel 162 will remain parallel to mounting surface 170 and receiving member plate 142 and top surface 151 of measuring block 150.

FIG. 5 depicts device 300 with an engaged flex-arm in a backward-tilted arrangement (as does FIG. 3, without an engaged flex-arm), and FIG. 6 depicts device 400 with an engaged flex-arm in a forward-tilted arrangement. Like in the upright arrangement of FIG. 4, the sides of grinding wheel 162 remain perpendicular to receiving member plate 142 and top surface 151 of measuring block 150, and the bottom of grinding wheel 162 is parallel to receiving member plate 142 and top surface 151 of measuring block 150. However, the sides and bottom of grinding wheel 162 are angled with respect to mounting surface 170. Therefore, measuring the angle of top surface 151 of measuring block 150 (with respect to mounting surface 170) will indicate the angle (again, with respect to mounting surface 170) of the sides and bottom of grinding wheel 162. In these arrangements, grinding wheel 162 mounted to flex-arm 160 may still be able to move in the directions of forward and backward, side to side and up and down, but the sides of grinding wheel 162 will remain perpendicular to receiving member plate 142 and top surface 151 of measuring block 150, and the bottom of grinding wheel 162 will remain parallel to receiving member plate 142 and top surface 151 of measuring block 150. For illustration, FIG. 5 depicts flex-arm mounted grinding wheel 162 that is positioned further away from extension member 161 when compared to the positions of the flex-arm mounted grinding wheels 162 of FIGS. 4 and 6 (i.e., through movement afforded by the dynamism of flex-arm 160, grinding wheel 162 was moved forward along a directional axis farther in FIG. 5 than in FIGS. 4 and 6). As shown in FIG. 5, even though moved forward through the dynamism of flex-arm 160, the bottom of grinding wheel 162 remains parallel to top surface 151 of measuring block 150. Accordingly, a measured angled surfaced may be accurately ground through utilization of device 100.

While particular embodiments and aspects of the present invention have been illustrated and described herein, various other changes and modifications can be made without departing from the spirit and scope of the invention. Moreover, although various inventive aspects have been described herein, such aspects need not be utilized in combination. It is therefore intended that the appended claims cover all such changes and modifications that are within the scope of this invention.

What is claimed is:

1. A flex-arm device comprising:

a base;

a support block attached to the base, the support block comprising a front and a rear that together define a shaft aperture and a channel extending perpendicular to the shaft aperture that intersects the shaft aperture;

a shaft rotationally engaged with the shaft aperture of the support block, the shaft selectively lockable to the shaft aperture;

a set member extending through the channel that decreases the width of the channel and the shaft aperture with the shaft in a locked orientation;

a flex-arm mount connected to the shaft for rotation therewith about a first axis of rotation;

a flex-arm rotationally engaged with the flex-arm mount for rotation about a second axis of rotation perpendicular to the first axis of rotation;

a measuring block attached to the shaft for rotation therewith about the first axis of rotation, the measuring block comprising a top surface; and a grinding wheel mounted on the flex-arm and coordinated with the top surface of the measuring block such that, as the flex-arm mount is rotated about the first axis of rotation, angles of inclination of the grinding wheel and top surface of the measuring block with respect to a surface upon which the device is mounted are substantially equivalent;

wherein the shaft is in an unlocked orientation when a width of the shaft aperture allows free rotation of the shaft within the shaft aperture such that the flex-arm mount may be angularly displaced about multiple positions, and the shaft is in the locked orientation when the set member reduces the width of the shaft aperture, which frictionally restricts free rotation of the shaft within the shaft aperture.

2. The device of claim 1, wherein the flex-arm is variably tiltable through the angular displacement of the flex-arm mount.

3. The device of claim 1, wherein the grinding wheel is capable of at least two types of displacement, a first displacement is dynamic, wherein the grinding wheel moves along at least two directional axes through a dynamism of the flex-arm, and a second displacement is angular, wherein the grinding wheel tilts through the angular displacement of the flex-arm mount.

4. The device of claim 1, wherein the set member is a threaded set member engageable with a threaded portion of a set member aperture of the support block.

5. The device of claim 4, wherein a rotational position of the set member determines a width of the shaft aperture and the channel.

6. The device of claim 1, wherein the top surface of the measuring block is parallel to a receiving member plate of the flex-arm mount.

7. The device of claim 6, wherein the measuring block is configured to measure the angle of inclination of the grinding wheel with respect to the surface upon which the device is mounted.

8. A flex-arm device comprising:

a base;

a pair of support blocks attached to the base, each support block comprising a front and a rear that together define a shaft aperture, a channel extending perpendicular to the shaft aperture that intersects the shaft aperture and a set member aperture that intersects the channel;

a shaft rotationally engaged with the shaft apertures;

two threaded set members engageable with a threaded portion of the set member apertures;

a flex-arm mount connected to the shaft for rotation therewith about a first axis of rotation;

a flex-arm rotationally engaged with the flex-arm mount for rotation about a second axis of rotation perpendicular to the first axis of rotation;

a measuring block attached to the shaft for rotation therewith about the first axis of rotation, the measuring block comprising a top surface; and a grinding wheel mounted on the flex-arm and coordinated with the top surface of the measuring block such that, as the flex-arm mount is rotated about the first axis of rotation, angles of inclination of the grinding wheel and top surface of the measuring block with respect to a surface upon which the device is mounted are substantially equivalent;

wherein rotational positions of the threaded set members determine widths of the shaft apertures and channels;

wherein in a locked orientation, the width of the shaft aperture of at least one of the pair of support blocks being reduced to prevent rotational movement of the shaft within the shaft apertures; and wherein in an unlocked orientation, the width of the shaft apertures of both of the pair of support blocks being increased to allow rotational movement of the shaft within the shaft apertures such that the flex-arm mount may be angularly displaced about multiple positions.

9. The device of claim 8, wherein the flex-arm is variably tiltable through the angular displacement of the flex-arm mount.

10. The device of claim 8, wherein the grinding wheel is capable of at least two types of displacement, a first displacement is dynamic, wherein the grinding wheel moves along at least two directional axes through a dynamism of the flex-arm, and a second displacement is angular, wherein the grinding wheel tilts through the angular displacement of the flex-arm mount.

11. The device of claim 8, wherein the top surface of the measuring block is parallel to a receiving member plate of the flex-arm mount.

12. The device of claim 11, wherein the measuring block is configured to measure the angle of inclination of the grinding wheel with respect to the surface upon which the device is mounted.

13. A method of angling a flex-arm mounted grinding wheel comprising:

providing a flex-arm device comprising a base, at least one support block attached to the base, the support block comprising a front and a rear that together define a shaft aperture and a channel extending perpendicular to the shaft aperture that intersects the shaft aperture, a shaft rotationally engaged with the shaft aperture of the support block, the shaft selectively lockable to the shaft aperture, and a flex-arm mount attached to the shaft for rotation therewith about a first axis of rotation;

engaging a flex-arm with the flex-arm mount for rotation therewith about a second axis of rotation perpendicular to the first axis of rotation, wherein a grinding wheel is mounted on the flex arm;

angling the grinding wheel through rotation of the shaft within the shaft aperture, wherein the flex-arm mount may be angularly displaced about multiple positions through rotation of the shaft, such that the flex-arm engaged with the flex-arm mount may be tilted to multiple positions through the angular displacement of the flex-arm mount, such that the grinding wheel may be tilted through the tilting of the flex-arm;

rotating a measuring block attached to the shaft for rotation therewith about the first axis of rotation, the measuring block including a top surface, wherein the grinding wheel is coordinated with the top surface of the measuring block such that, as the flex-arm mount is angularly displaced, an angle of inclination of the grinding wheel with respect to a surface upon which the device is mounted is substantially equivalent to an angle of inclination of the top surface of the measuring block with respect to the surface upon which the device is mounted; and locking the flex-arm in any one of the multiple positions by decreasing the widths of the shaft aperture and the channel using a set member extending through the channel.

14. The method of claim 13, wherein the set member comprises a threaded bolt engageable with a threaded portion of a set member aperture of the support block.

15. The method of claim 14, wherein a rotational position of the set member determines the width of the shaft aperture wherein a first width of the shaft aperture positions the device in a locked orientation and a second width of the shaft aperture positions the device in an unlocked orientation, wherein when the device is in a locked orientation, the shaft is restricted from rotation within the shaft aperture, and when the device is in an unlocked orientation, the shaft is capable of rotation within the shaft aperture such that the flex-arm mount may be angularly displaced about multiple positions.

16. The method of claim 13, wherein the top surface of the measuring block is parallel to a receiving member plate of the flex-arm mount.

17. The method of claim 16, wherein the measuring block is configured to measure an angle of inclination of a grinding wheel mounted on a flex-arm engaged with the flex-arm mount, wherein the angle of inclination is measured with respect to a surface upon which the device is mounted.

18. The method of claim 13, wherein a bottom surface of the grinding wheel and the top surface of the measuring block are parallel as the flex-arm mount is rotated about the first axis of rotation.

19. The device of claim 8, wherein a bottom surface of the grinding wheel and the top surface of the measuring block are parallel as the flex-arm mount is rotated about the first axis of rotation.

20. The device of claim 1, wherein a bottom surface of the grinding wheel and the top surface of the measuring block are parallel as the flex-arm mount is rotated about the first axis of rotation.

* * * * *